United States Patent [19]

Haus

[11] 4,101,880

[45] Jul. 18, 1978

[54] AUDIOVISUAL SIGNALING DEVICE

[75] Inventor: Rein Haus, Long Branch, N.J.

[73] Assignee: Wheelock Signals, Inc., Long Branch, N.J.

[21] Appl. No.: 754,740

[22] Filed: Dec. 27, 1976

[51] Int. Cl.[2] ..... G08B 7/00

[52] U.S. Cl. ..... 340/326; 315/241 S; 340/331; 340/371; 340/384 E

[58] Field of Search ..... 340/326, 331, 332, 384 E, 340/371, 75, 77, 88, 105; 315/241 S; 116/3

[56] References Cited

U.S. PATENT DOCUMENTS

| | | | |
|---|---|---|---|
| 2,809,366 | 10/1957 | Van Boort et al. | 340/105 |
| 3,145,375 | 8/1964 | Webb | 340/331 |
| 3,618,079 | 11/1971 | Denning et al. | 340/331 |
| 3,774,186 | 11/1973 | Enemark | 340/384 E |
| 3,810,149 | 5/1974 | Miller et al. | 340/331 |
| 3,866,211 | 2/1975 | Curtis | 340/332 |
| 3,916,404 | 10/1975 | Gouge | 340/332 |

*Primary Examiner*—Caldwell, Sr., John W.
*Assistant Examiner*—James J. Groody
*Attorney, Agent, or Firm*—Brumbaugh, Graves, Donohue & Raymond

[57] ABSTRACT

An audiovisual signaling device including an auditory signaling means, an inductor for energizing the signaling device, and a circuit interruptor in series circuit with the inductor. A flashtube is electrically connected to the inductor and interruptor, and the inductor acts as an electromagnet when a voltage is impressed across the inductor and interruptor. The series circuit is intermittently interrupted by the interruptor, and the flashtube is actuated in response to the decaying magnetic field of the inductor when the circuit is thus interrupted.

11 Claims, 2 Drawing Figures

AUDIOVISUAL SIGNALING DEVICE

BACKGROUND OF THE INVENTION

This invention relates to audiovisual signaling devices for use on emergency vehicles, at construction sites, in burglar-alarm and fire-alarm systems, etc., and, more particularly, to a novel and highly effective audiovisual signaling device that performs better but is simpler and less expensive than similar devices known heretofore.

Audiovisual signaling devices are very important in many applications, especially those having to do with public safety. For example, fire-alarm systems ideally include (and in some jurisdictions are required by law to include) both auditory signals and visual signals in order to maximize the probability that they will attract attention in an emergency. Obviously, those who are nearly or totally without sight respond uncertainly or not at all to visual signals, and those who are nearly or totally withohut hearing respond uncertainly or not at all to auditory signals. Thus, a certain small fraction of the population is not adequately protected by an emergency signal that appeals solely to sight or solely to hearing. Moreover, even persons with normal sight and hearing are more likely to notice a signal that is both auditory and visual. For example, when the background "noise" (light or sound) is very intense, the visual or auditory part of the signal, as the case may be, is less readily detected. It is not always possible to know in advance whether the background light or sound will be sufficiently low to permit reliable detection of a visual or auditory signal. By providing two such signals "in parallel" so to speak, the chance that persons to be protected will respond to at least one of the signals under a wide variety of environmental conditions is improved.

Moreover, even under relatively ideal environmental conditions (low ambient light and sound levels), one with normal sight and hearing may nevertheless fail to respond to a signal that is solely auditory or solely visual, simply because the head is turned in the wrong direction, or because one is asleep, or because one's attention is directed elsewhere.

The advantages of audiovisual signals as compared to signals that are merely auditory or merely visual are well recognized, and numerous audiovisual signaling devices are known. However, all audiovisual signaling devices known heretofore have certain drawbacks.

A horn has much to recommend it as a means for producing the auditory portion of the signal, since it produces a strong signal in relation to the power consumed and is inexpensive and rugged. However, horns vibrate in operation to such an extent that they may damage nearby structure, particularly the (necessarily fragile) filament of an incandescent bulb that may be used as a means for producing the visual portion of the signal. The likelihood of filament rupture is even greater when the signaling device is used on mobile equipment such as a police car, fire truck, ambulance, bulldozer, or crane. Moreover, the arcing associated with the repeated opening of the horn contacts must be suppressed by special circuitry or else will cause radio-frequency interference (RFI) and pitting of the contacts.

A xenon flashtube has much to recommend it as a means for producing the visual portion of the signal, since it also produces a strong signal in relation to the power consumed and is inexpensive per se and rugged enough to withstand the shocks typically encountered during service on mobile equipment and the vibrations of even the most powerful commercial horns. However, it is necessary, if a xenon flashtube is used, to provide a very high starting voltage Heretofore, this has required the incorporation of relatively complex and expensive circuitry.

SUMMARY OF THE INVENTION

An object of the invention is to remedy the problems outlined above and, in particular, to provide an audiovisual signaling device that produces a high output —both auditory and visual —in relation to the input power, that is reliable and resistant to shock and vibration, that is simpler and less expensive and has a longer life expectancy than similar devices known heretofore, and that causes little or no RFI.

The foregoing and other objects are attained in accordance with the invention by providing an audiovisual signaling device comprising audio signaling means, induction means for energizing the signaling means, and contacts in series circuit with the induction means. Means is provided for applying a voltage across the induction means and contacts, and flashtube means is provided in operative association with the induction means and contacts. The induction means acts as an electromagnet when a voltage is impressed across the induction means and contacts, thus causing intermittent separation of the contacts and interruption of the series circuit including the induction means and contacts. The flashtube means is actuated in response to the back electromotive force (EMF) associated with the decaying magnetic field of the induction means when the circuit is thus interrupted.

In the preferred embodiment of the invention, the following additional features are also incorporated:

The audio signaling means comprises a horn, and the induction means comprises a horn coil.

The flashtube means comprises a xenon flashtube connected to the series circuit including the induction means and contacts.

The flashtube means also comprises a capacitor in parallel with the xenon flashtube, whereby the capacitor is charged in response to the interruption of the series circuit including the induction means and contacts.

Ionization means is provided for producing ionization within the xenon flashtube, and the capacitor discharges through the xenon flashtube in response to such ionization.

The ionization means comprises switch means in parallel with the xenon flashtube, a trigger capacitor in parallel with the switch means, and pulse transformer means operatively associated with the trigger capacitor and the xenon flashtube. When the switch means is open, the trigger capacitor is charged in response to the interruption of the series circuit including the induction means and contacts, and, when the switch means is closed, the trigger capacitor discharges through the switch means, thus actuating the pulse transformer means.

The pulse transformer means comprises a primary coil in series with the trigger capacitor and a secondary coil inductively coupled to the primary coil and operatively associated with the xenon flashtube. The secondary coil has more turns than the primary coil in order to step up the voltage.

The switch means comprises a neon tube, whereby the trigger capacitor discharges through the neon tube when the voltage across the trigger capacitor equals the breakdown voltage of the neon tube, this automatically closing the switch means.

Resistor means is provided in circuit with the ionization means for providing a degree of isolation between the capacitors and, if the amount of available energy is sufficiently high, setting the triggering rate of the device.

Rectifier means is provided in circuit with the flashtube means for holding a charge on the capacitors prior to discharge thereof through the xenon flashtube and switch means, respectively.

BRIEF DESCRIPTION OF THE DRAWING

A better understanding of the invention may be gained from a consideration of the following detailed description of the preferred embodiments thereof, in conjunction with the appended figures of the drawing, wherein.

DESCRIPTION OF THE PREFERRED EMBODIMENTS

Figure 1:
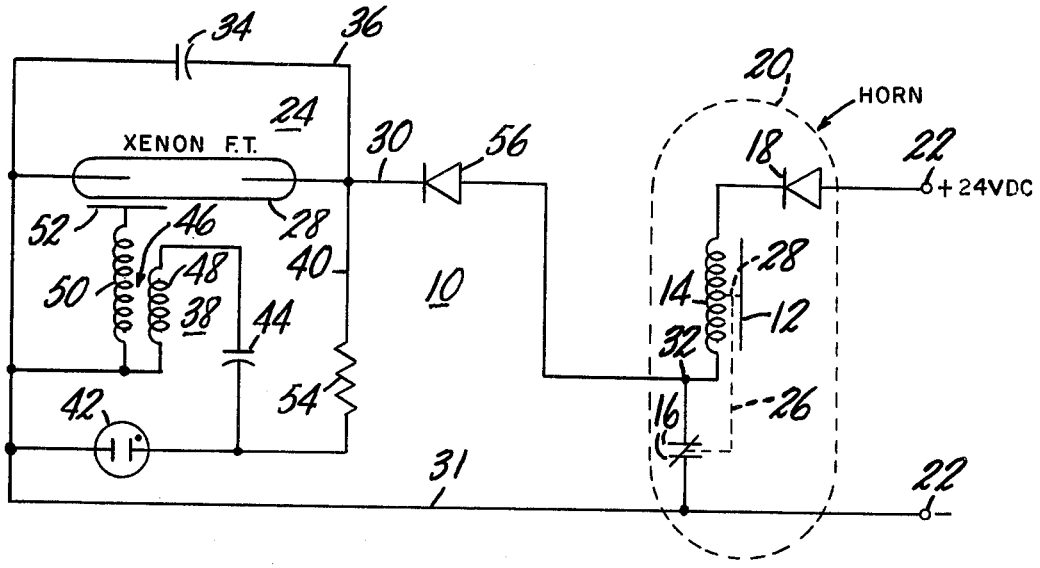
FIGS. 1 and 2 are schematic views showing, respectively, two preferred embodiments of apparatus constructed in accordance with the invention.

FIG. 1 shows an audiovisual signaling device 10 constructed in accordance with the invention and comprising auditory signaling means such as a horn diaphragm 12, induction means such as a horn coil 14 for energizing the auditory signaling means, as by causing the diaphragm 12 to vibrate, and make-break horn contacts 16 in series circuit with the horn coil 14. A diode 18 is also in series with the horn coil 14 and horn contacts 16. The diaphragm 12, coil 14, contacts 16, and diode 18 may be physically incorporated in a horn 20 (indicated schematically by the broken line) various models of which are available commercially. Means such as terminals 22 is provided for applying a voltage, typically 24 volts DC, across the horn coil 14 and horn contacts 16.

The horn coil 14 acts as an electromagnet when a DC voltage is impressed across the horn coil 14 and contacts 16. This causes intermittent separation of the contacts 16, as indicated by the dotted line 26, and hence intermittent interruption of the series circuit including the horn coil 14 and horn contacts 16, as well as vibration of the diaphragm 12, as indicated by the dotted line 28. Flashtube means 24 is operatively associated with the horn coil 14 and horn contacts 16, and the flashtube means 24 is actuated in response to the decaying magnetic field of the horn coil 14 when the circuit is thus interrupted.

The flashtube means 24 comprises a xenon flashtube 28 connected to the series circuit including the horn coil 14 and horn contacts 16 by a lead 30, which extends from the junction 32 between the horn coil 14 and horn contacts 16, and by a return lead 31, which extends to the negative terminal 22. The flashtube means 24 further comprises a capacitor 34 in parallel with xenon tube 28. The capacitor 34 is also connected both to the junction 32 (by the lead 30 and a lead 36) and to the negative terminal 22 (by the lead 31).

The capacitor 34 is thus charged in response to the interruption of the series circuit including the horn coil 14 and horn contacts 16 as the magnetic field of the horn coil 14 decays. In prior devices, the magnetic field of the horn coil of course also decays when the contacts separate, but the resulting back EMF serves no useful purpose and is thus "wasted". Worse than that, unless special arc-suppression circuitry is employed, it causes arcing across the contacts, which in turn causes pitting of the contacts and shortens their life. The arcing moreover is a source of RFI. In accordance with the present invention, as developed more fully below, the back EMF is not wasted but is employed to ignite the xenon flashtube 28. Arcing across the contacts 16 is suppressed automatically without additional circuitry, since the capacitor 34, which is of large capacitance and is connected directly to the junction 32 without an intervening source of impedance, "absorbs" the current resulting from the collapsing magnetic field of the horn coil 14.

This produces a number of important benefits, including the following:

(1) No energy is required for operation of the flashing light beyond what is required in any case for operation of the horn. The operation of the flashing light is thus "free," in marked contrast to the case of a flashing incandescent light as used in the prior art, the operation of which typically requires at least as much power as does the operation of the horn. That is, the horn-light combination of the present invention draws about as much power as a horn of the prior art operating without a light, or about half as much power as a horn-light combination typical of the prior art.

(2) The life of the contacts is significantly extended.

(3) RFI is reduced or eliminated.

(4) The relative complex and expensive circuitry otherwise required for operation of the xenon flashtube can be dispensed with. Specifically, in devices of the prior art, where the supply voltage is 24 VDC, voltage converter means is necessary, since 24 volts is insufficient for operation of the device. In accordance with the present invention, the back EMF, which is inherently much higher than 24 volts, is employed to charge the capacitors 34 and 44, and voltage converter means is unnecessary.

Ionization means 38, powered by the back EMF of the horn coil 14, is provided in operative association with the xenon flashtube 28 in order to actuate it. The ionization means 38 is also connected both to the junction 32 (by the lead 30 and a lead 40) and to the negative terminal 22 (by the lead 31). When charged, the capacitor 34 discharges through the xenon flashtube 28 only when the ionization means 38 produces ionization within the tube 28, thus causing a drop in the resistance of the xenon tube 28. The intensity of the resulting light burst depends on the amount of charge accumulated on the capacitor 34 prior to the ionization.

The ionization means 38 comprises switch means such as a neon tube 42 in parallel with the xenon flashtube 28, a trigger capacitor 44 in parallel with the switch means 42, and pulse transformer means 46 operatively associated with the trigger capacitor 44 and the xenon flashtube 28. When the neon tube 42 is nonconducting, thus forming an open switch, the trigger capacitor 44 is charged in response to the interruption of the series circuit including the horn coil 14 and horn contacts 16. When the voltage across the trigger capacitor 44 equals the breakdown voltage of the neon tube 42, the latter conducts, thus automatically forming a closed switch. The trigger capacitor 44 then discharges through the neon tube. This actuates the pulse transformer means 46.

The pulse transformer means 46 comprises a primary coil 48 in series with the trigger capacitor 44 and a secondary coil 50 inductively coupled to the primary coil 48 and operatively associated with the xenon tube 28 by means of an electrode 52 closely positioned about the xenon tube 28. The secondary coil 50 has more turns than the primary coil 48, in a ratio of perhaps 20 to 1, thus providing a 20-to-1 step-up in voltage.

Resistor means such as a resistor 54 is provided in circuit with the ionization means 38 and between the capacitors 34 and 44 for providing a degree of isolation between the capacitors 34 and 44 so that the capacitor 34 discharges through the xenon tube 28 rather than through the neon tube 42. In addition, as the amount of available energy increases, the resistor 54 becomes increasingly effective as a means for setting the self-triggering rate of the device. Specifically, the higher the resistance of the resistor 54, the more slowly the capacitor 44 charges, and the longer it takes for the voltage on the capacitor 44 to equal the breakdown voltage of the neon tube 42. The resistor 54 can have a fixed resistance, in which case the triggering rate is set once and for all at the factory, or a variable resistance, in which case field adjustments can be made.

Rectifier means such as a diode 56 is provided in circuit with the flashtube means 24 for holding a charge on the capacitors 34 and 44 prior to discharge thereof through the xenon flashtube 28 and the switch means 42, respectively.

The following Table I shows representative types and values of the elements described above in connection with the embodiment of FIG. 1:

TABLE I

| ELEMENT | DESCRIPTION |
|---|---|
| Capacitor 34 | 10μf, 250 volts (electrolytic) |
| Capacitor 44 | 0.1μf, 250 volts (metalized foil) |
| Resistor 54 | 220KΩ, ¼ watt |
| Diode 56 | 1N4004, 1 Amp, 400 volts |
| Xenon Flashtube 28 | Siemens No. AG1015, 160 volts min. |
| Pulse Transformer 46 | Shigoto No. TR-4KN, $E_{in}$ = 200, $E_{out}$ = 4000 |
| Neon Tube 42 | Signalite No. A432, 180–200 volts breakdown |
| Horn 20 | Wheelock Signals No. 34–24, 1.5 watts |

In operation, the contacts 16 of circuitry as disclosed above in connection with FIG. 1 open and close many dozen times a second, causing an incremental charging of the capacitors 34 and 44 each time they open. The accumulated charges are held in the capacitors 34 and 44 by the diode 56. After about half a second, the neon tube 42 breaks down, which causes a brief burst of light from the flashtube 28. The audiovisual signaling device thus produces a flashing light of high intensity and a (typically raucous) horn sound that fluctuates or pulsates in synchronism with the light bursts, since the horn contacts are momentarily shunted by the discharged capacitor 34.

Figure 2:
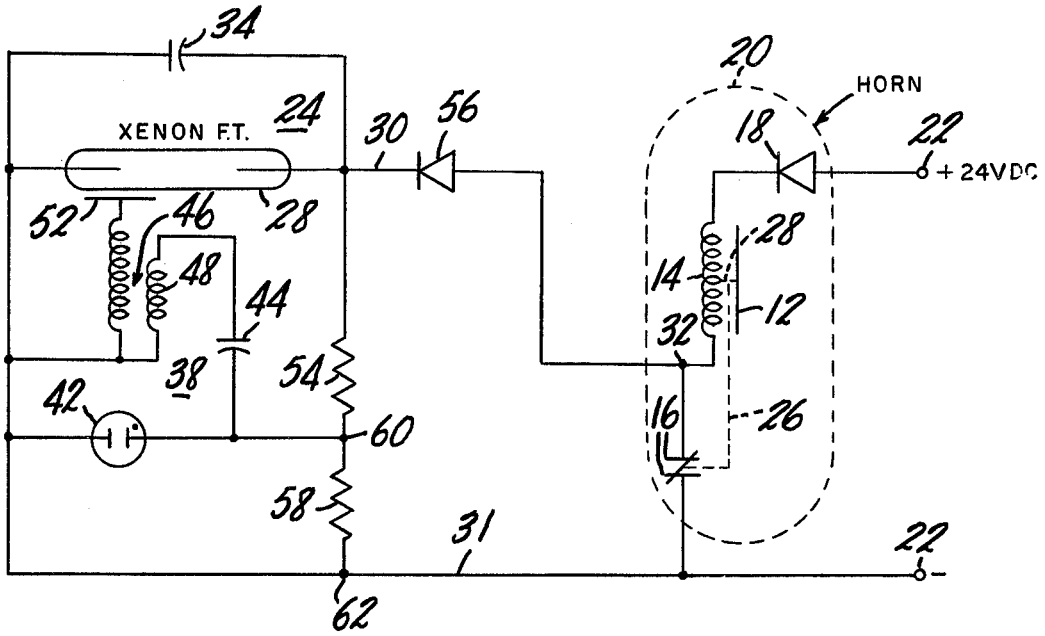

FIG. 2 is similar to FIG. 1 but shows an additional resistor 58 having a junction 60 with the negative side of the resistor 54 and a junction 62 with the negative return line 31. The resistors 54, 58 of FIG. 2 constitute an alternate resistor means for isolating capacitors 34 and 44 and for setting the triggering rate of the device.

Thus there is provided in accordance with the invention a novel and highly effective audiovisual signaling device.

Many modifications within the spirit and scope of the invention will readily occur to those skilled in the art upon consideration of this disclosure. For example, a bell or buzzer may be substituted for the horn 20, a mechanical push-button switch, solid-state switch or relay may be substituted for the neon tube 42, and alternative circuit-interruption means such as an NPN transistor having its collector connected to the negative side of the coil 14, its emitter connected to the lead 31, and its base driven by an oscillator at a frequency compatible with the spring mass system of the horn (say 200 or 300 Hertz) may be substituted for the horn contacts 16. Accordingly, the invention extends to all structure embraced within the scope of the appended claims and equivalents thereof.

I claim:

1. An audiovisual signaling device comprising auditory signaling means, induction means for energizing said signaling means, circuit-interruption means in series circuit with said induction means, and flashtube means electrically connected to said induction means and interruption means, said induction means acting as an electromagnet when a voltage is impressed across said induction means and interruption means, said series circuit being intermittently interrupted by said interruption means, and said flashtube means being actuated in response to the decaying magnetic field of said induction means when said circuit is thus interrupted.

2. An audiovisual signaling device according to claim 1 wherein said auditory signaling means comprises a horn and said induction means comprises a horn coil.

3. An audiovisual signaling device according to claim 1 wherein said flashtube means comprises a xenon flashtube connected to said series circuit.

4. An audiovisual signaling device according to claim 1 wherein said flashtube means comprises a xenon flashtube and a capacitor in parallel therewith, each being connected to said series circuit, whereby said capacitor is charged in response to said interruption of said series circuit.

5. An audiovisual signaling device according to claim 1 wherein said flashtube means comprises a xenon flashtube, a capacitor in parallel therewith, and ionization means operatively associated with said xenon flashtube, each being connected to said series circuit, whereby said capacitor is charged in response to said interruption of said series circuit and discharges through said xenon flashtube in response to ionization produced within said xenon flashtube by said ionization means.

6. An audiovisual signaling device according to claim 5 wherein said ionization means comprises switch means in parallel with said xenon flashtube, a trigger capacitor in parallel with said switch means, and pulse transformer means operatively associated with said trigger capacitor and said xenon flashtube, whereby, when said switch means is open, said trigger capacitor is charged in response to said interruption of said series circuit, and, when said switch means is closed, said trigger capacitor discharges through said switch means, thus actuating said pulse transformer means.

7. An audiovisual signaling device according to claim 6 wherein said pulse transformer means comprises a primary coil in series with said trigger capacitor and a secondary coil inductively coupled to said primary coil and operatively associated with said xenon flashtube, said secondary coil having more turns than said primary coil.

8. An audiovisual signaling device according to claim 6 wherein said switch means comprises a neon tube, whereby said trigger capacitor discharges through said neon tube when the voltage across said trigger capacitor equals the breakdown voltage of said neon tube, thus automatically closing said switch means.

9. An audiovisual signaling device according to claim 6 further comprising resistor means in circuit with said ionization means, at least a portion of the resistance thereof being between said capacitors.

10. An audiovisual signaling device according to claim 6 further comprising rectifier means in circuit with said flashtube means for holding a charge on said capacitors prior to discharge thereof through said xenon flashtube and said switch means, respectively.

11. An audiovisual signaling device according to claim 1 wherein said circuit interruption means comprises a pair of make-break contacts.

* * * * *